United States Patent [19]

Chase et al.

[11] Patent Number: 4,695,045

[45] Date of Patent: Sep. 22, 1987

[54] APPARATUS FOR SECURING A CATHODE-RAY TUBE DURING PROCESSING

[75] Inventors: Thomas L. Chase; Kenneth A. Long, both of Lancaster, Pa.

[73] Assignee: RCA Corporation, Princeton, N.J.

[21] Appl. No.: 889,625

[22] Filed: Jul. 28, 1986

[51] Int. Cl.[4] ..... B25B 1/14

[52] U.S. Cl. ..... 269/152; 269/228; 269/286; 269/908

[58] Field of Search ..... 269/908, 228, 152, 115, 269/104, 156, 286

[56] References Cited

U.S. PATENT DOCUMENTS

| | | | |
|---|---|---|---|
| 1,369,454 | 2/1921 | Mathy | 269/908 |
| 1,626,628 | 5/1927 | Rotherham | 269/908 |
| 2,054,572 | 9/1936 | McKenna | 269/228 |
| 2,165,322 | 7/1939 | Weston | 269/228 |
| 2,564,897 | 8/1951 | Hahn | 269/908 |
| 2,792,810 | 3/1954 | Maconeghy | 269/908 |
| 3,028,577 | 4/1962 | Strauss | 269/228 |
| 3,391,635 | 7/1968 | Matheus | 269/228 |
| 3,425,098 | 2/1969 | Bredvik | 269/228 |
| 4,138,085 | 2/1979 | Bicskei | 269/228 |
| 4,335,873 | 6/1982 | Kiefer | 269/228 |
| 4,507,873 | 4/1985 | Berardi . | |
| 4,550,344 | 10/1985 | Buckley . | |

*Primary Examiner*—Robert C. Watson

*Attorney, Agent, or Firm*—E. M. Whitacre; D. H. Irlbeck; T. H. Magee

[57] ABSTRACT

An apparatus and method for holding a cathode-ray tube in a fixed position during processing utilizes mounting lugs attached to the tube. The apparatus includes a platform having a plurality of legs positioned to support, respectively, the ends of the mounting lugs. Each of the legs has a recess therein aligned with an aperture in the respective lug end. Each lug is secured to the respective leg by a clamp, pivotally attached to each leg, which projects through the aperture into the respective recess when pivoted.

6 Claims, 2 Drawing Figures

APPARATUS FOR SECURING A CATHODE-RAY TUBE DURING PROCESSING

BACKGROUND OF THE INVENTION

This invention pertains to an apparatus for holding a cathode-ray tube in a fixed position during processing, such as a faceplate mechanical grind operation.

In manufacturing a cathode-ray tube, an antiglare surface is put on the faceplate of the tube by a dry mechanical grind operation in order to reduce the gloss on the faceplate surface. It is important that the tube be held in a fixed plane during this operation so that a uniform surface finish is put on the faceplate. Presently, a fiberglass mold is fitted to the funnel of the cathode-ray tube, and this "saddle" fixture supports the tube during the mechanical grind operation.

During this processing, the cathode-ray tube has a tendency to shift and jump out of the saddle fixture, which presents a safety hazard in the factory. Whenever the tube shifts, the saddle fixture removes a conductive coating from scuffed areas where the external surface of the funnel contacts the saddle fixture. This requires the completed tube to be repainted with conductive paint. Also, since the saddle fixture does not secure the tube in a fixed plane, there is a tendency not to get a completely uniform surface finish on the faceplate. The present apparatus and method overcome the above disadvantages by holding the cathode-ray tube in a fixed position during such processing.

SUMMARY OF THE INVENTION

The present invention comprises an apparatus and method for holding a cathode-ray tube in a fixed position during processing by utilizing mounting lugs attached to the tube. The apparatus includes a platform having a plurality of legs positioned to support, respectively, the ends of the mounting lugs. Each of the legs has a recess therein aligned with an aperture in the respective lug end. Each lug is secured to the respective leg by a clamp, pivotally attached to each leg, which projects through the aperture into the respective recess when pivoted.

DETAILED DESCRIPTION OF THE PREFERRED EMBODIMENT

Figure 1:
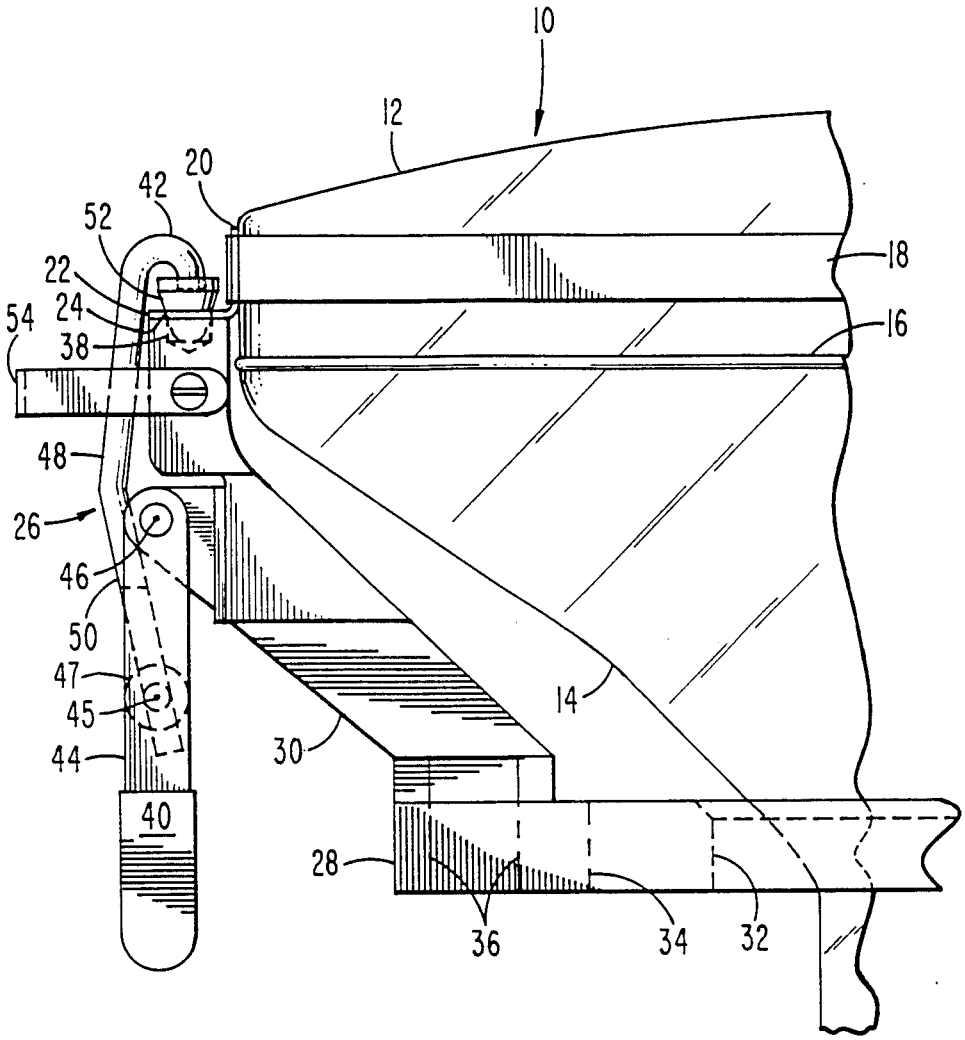
FIG. 1 is a partial elevation view illustrating the apparatus of the present invention holding a cathode-ray tube.

FIG. 1 shows a cathode-ray tube 10 having a faceplate panel 12 sealed to a funnel 14 thereof along an edge 16 of the panel 12. The faceplate panel 12 is substantially rectangular in shape and is encircled by a tensioned implosion protection band 18. The band 18 typically is metal and exerts a compressive force on the sidewall of the panel 12. Substantially L-shaped mounting lugs 20 are disposed between the metal band 18 and the sidewall of the panel 12 at the four corner locations. Each of the lugs 20 has an end 22 which projects away from the tube 10 and contains an aperture 24 subsequently used for mounting the tube 10 in a video monitor and/or television receiver. The lugs 20 are usually attached after the mount sealing and exhausting of the tube 10 are completed.

In the present invention, the cathode-ray tube 10 is held in a fixed position during processing utilizing the mounting lugs 20. It has been discovered that the tube 10 can be securely held by the lugs 20 in a support fixture during the mechanical grind operation without having the lug position distorted by the polish and grind machine. Such a fixture eliminates the need to respray the conductive coating on the external surface of the tube funnel 14.

Figure 2:
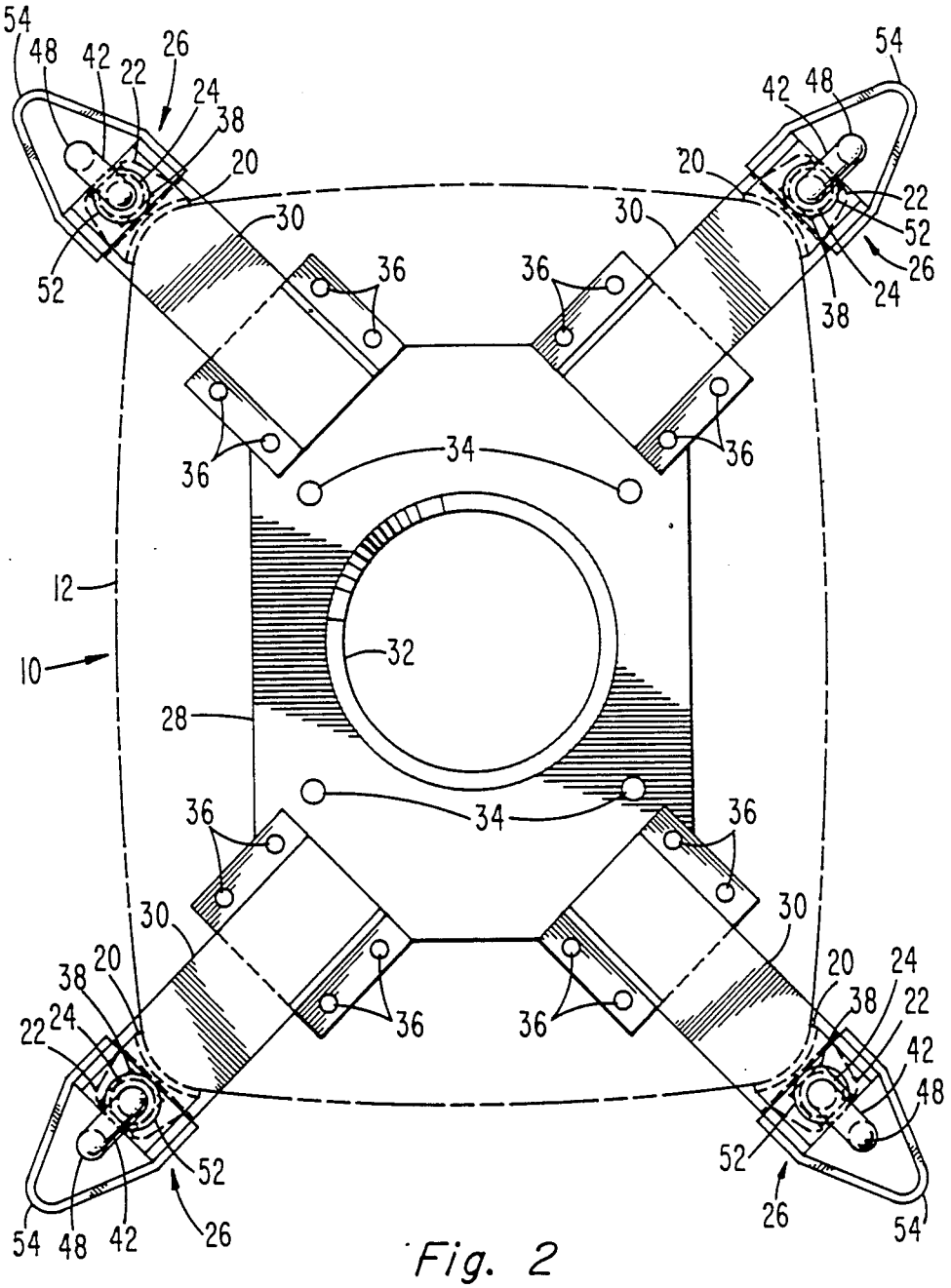
FIG. 2 is a plan view illustrating the present apparatus.

FIGS. 1 and 2 show a tube-support apparatus 26 comprising a horizontal platform 28 having four upwardly extending legs 30 postioned to support, respectively, the ends 22 of the mounting lugs 20. The platform 28 has a circular opening 32 in the center to permit the neck portion of the funnel 14 to extend therethrough, as shown in FIG. 1, and bolt openings 34 for further attachment to supporting equipment (not shown). Each leg 30 is connected, respectively, to a corner of the platform 28 by bolts 36, and has a recess 38 therein aligned with the aperture 24 in the respective lug end 22 supported by that leg 30.

Means 40 are pivotally attached to each of the legs 30 for clamping the respective lug 20 to the leg 30 by projecting an end portion 42 of the clamping means 40 through the aperture 24 into the respective recess 38 when pivoted. Each of the clamping means 40 comprises a handle 44 rotably attached to the respective leg 30 for pivoting about a fixed axis 46. Each clamping means 40 also includes a J-shaped clamp 48 having a substantially straight portion 50 rotatably attached to the handle 44 about a movable axis 45, and a curved end portion 42 positioned to project through the respective aperture 24, as shown in FIG. 1. Each of the straight portions 50 is attached to the respective handle 44 in a manner that allows each straight portion 50 to move laterally along the movable axis 45. This is accomplished by either a resilient spring washer 47, or simply a loose fitting. Preferably, each of the curved portions 42 has a cone-shaped tip 52 disposed at the end thereof for forming a press fit with both the respective aperture 24 and the recess 38. In the present embodiment, the cone-shaped tips 52 are made of nylon.

The apparatus 26 further comprises means attached to each of the legs 30 for keeping the respective J-shaped clamp 48 in an upright position proximate the recess 38 when the clamp 48 is in an unclamped mode. In the present embodiment, each of the keeping means comprises a U-shaped loop 54 attached at both ends to the respective leg 30, as shown in FIGS. 1 and 2. The loops 54 may be made of aluminum.

In operation, the cathode-ray tube 10, with four mounting lugs 20 attached to the corners of the tube 10, is placed on the support apparatus 26 by supporting the ends 22 of the lugs 20, respectively, on the distal end surfaces of the legs 30 so that the recess 38 in each leg 30 is aligned with the aperture 24 in the respective end 22. The cone-shaped tips 52 are positioned, respectively, to project through the apertures 24, and each lug 20 is then clamped to the respective leg 30 by pivoting each handle 44 away from the lug 20 until each of the curved end portions 42 securely holds each lug 20 to the respective leg 30. As each handle 44 rotates about the respective fixed axis 46, the end portions 42 are forced downward through the apertures 24 and into the respective recesses 38. The cone-shaped tips 52 are thereby inserted, respectively, through the apertures 24 and into the recesses 38 to form a press fit with both the respective aperture 24 and recess 38, thereby securely holding the lugs 20 to the respective legs 30. Since each J-shaped clamp 48 is able to move laterally along the movable axis 45, the lugs 20 are able to be clamped to the legs 30 without changing their positions even though such positions are slightly different from tube to tube.

Data measurements were made on several tubes to determine whether the lug position changed during processing with the present support apparatus 26. It was discovered that the tube 10 can be securely held in the support apparatus 26 during the mechanical grind operation without having the lug position distorted or appreciably changed by the polish and grind machine. Since the apparatus 26 secures the tube 10 in a fixed plane, a uniform surface gloss is able to be placed on the faceplace. The present technique also eliminates the need to respray the conductive coating on the tube 10. In addition, since the tube is live (has been partially exhausted of gases) during the mechanical grind process, the apparatus 26 removes a factory safety hazard by preventing the tube from shifting and jumping out of the support fixture.

What is claimed is:

1. An apparatus for securing a cathode-ray tube during processing utilizing mounting lugs attached to said tube, each of said lugs having an end projecting away from said tube and containing an aperture, comprising:

a platform having a plurality of legs positioned to support, respectively, the ends of said moutning lugs, each of said legs having a receess therein aligned with the aperture in said respective end, and means pivotally attached to each of said legs for clamping said respective lug to said leg by projecting an end portion of said clamping means through said aperture into the respective recess when pivoted, each of said clamping means comprising a handle rotatably attached to the respective leg for pivoting about a fixed axis, and also a J-shaped clamp having a substantially straight portion rotatably attached to said handle about a movable axis and a curved end portion rigidly fixed to said straight portion and positioned to project through said respective aperture, each of said straight portions being attached to said respective handle in a manner that allows each straight portion to move laterally along and rotate feely about said movable axis, whereby said curved portions securely hold said lugs to said respective legs when said handles are pivoted away from said lugs.

2. An apparatus as defined in claim 1 wherein each of said curved portions has a cone-shaped tip disposed at the end thereof for forming a press fit with both the respective aperture and recess.

3. An apparatus as defined in claim 2 wherein each of said cone-shaped tips is made of nylon.

4. An apparatus as defined in claim 1 further comprising means attached to each of said legs for keeping the respective J-shaped clamp in an upright position proximate said recess when said clamp is in an unclamped mode.

5. An apparatus as defined in claim 4 wherein each of said keeping means comprises a U-shaped loop attached at both ends to the respective leg.

6. An apparatus as defined in claim 1 wherein said platform has four legs.

* * * * *